United States Patent [19]

Flatau

[11] 4,212,244

[45] Jul. 15, 1980

[54] SMALL ARMS AMMUNITION

[76] Inventor: Abraham Flatau, 2004 Stockton Rd., Joppa, Md. 21085

[21] Appl. No.: 858,934

[22] Filed: Dec. 9, 1977

Related U.S. Application Data

[63] Continuation of Ser. No. 844,863, Oct. 25, 1977, abandoned, which is a continuation-in-part of Ser. No. 567,962, Apr. 14, 1975, abandoned.

[51] Int. Cl.[2] ..... F42B 5/00

[52] U.S. Cl. ..... 102/38 MM; 102/93; 102/DIG. 10

[58] Field of Search ..... 102/38 R, 38 MM, 92.1–92.6, 102/93, DIG. 10

[56] References Cited

U.S. PATENT DOCUMENTS

| | | | |
|---|---|---|---|
| 1,376,530 | 5/1921 | Greener | 102/DIG. 10 |
| 3,598,057 | 8/1971 | Potter | 102/93 |
| 3,877,383 | 4/1975 | Flatau | 102/93 |
| 3,919,799 | 11/1975 | Austin, Jr. | 102/DIG. 10 |
| 3,980,023 | 9/1976 | Misevich | 102/DIG. 10 |

FOREIGN PATENT DOCUMENTS

| | | | |
|---|---|---|---|
| 308434 | 2/1920 | Fed. Rep. of Germany | 102/92.1 |
| 844987 | 5/1939 | France | 102/93 |

*Primary Examiner*—Charles T. Jordan

*Attorney, Agent, or Firm*—Nathan Edelberg; Robert P. Gibson; Harold H. Card, Jr.

[57] ABSTRACT

Ammunition for small arms using ring airfoils.

4 Claims, 13 Drawing Figures

SMALL ARMS AMMUNITION

DEDICATORY CLAUSE

The invention described herein may be manufactured, used, or licensed by or for the U.S. Government for governmental purposes without the payment to me of any royalty thereon.

RELATED APPLICATIONS

This application is a continuation of application Ser. No. 844,863 filed 25 Oct. 1977 which was a continuation-in-part of application Ser. No. 567,962 filed 14 Apr. 1975, both abandoned.

BACKGROUND OF THE INVENTION

This invention relates to new forms of ammunition for small arms like rifles, shotguns and handguns. Conventional cartridges typically comprise a cylindrical case of metal, pasteboard or plastic for holding primer means, powder and the necessary propellant medium with wad and shot, a bulbous bullet, or a projectile secured in the end of the cartridge case. By detonating the primer, the powder is ignited causing gas pressure from the burned powder to separate the bullet or projectile from the cartridge.

In the design of ammunition for rifles, shotguns and pistols, numerous trade-off with the accuracy of the projectile, mass of the projectile, muzzle velocity of the projectile and recoil of the firearm must be made. With rifle ammunition, accuracy and range are generally fixed requirements, and are accomplished by use of relatively long barrels. Muzzle velocity and air resistance control and limit bullet range. Gravity commences to act on the bullet as it leaves the muzzle. Recoil on the user depends upon the mass of the gun and projectile, as well as the propellant or powder charge, and the use of recoiling devices which dissipate some of the reaction forces. The firing of a single shot with all rifle parts stationary as the bullet leaves the muzzle permits a higher degree of pinpoint accuracy than handguns or fully automatic weapons normally achieve.

With the shotgun, a cluster of small lead spheres or shot is directed toward small or fast-moving targets with hit probability depending not so much on aiming accuracy, but upon the expanded area of coverage achieved by the divergent pattern of the shot. There is no attempt in the design of shotgun shells to achieve a controlled pattern in the distribution area of the shot, except by variation of the barrel choke. A severe limitation in shotguns is the fact that the shot scatters very widely apart as it proceeds toward the target, whereby only 5 percent or less of the total mass hits the target. Even 50 feet from the shooter, the shot is no longer lethal, but merely peppers the target harmlessly. Alternatively, single slug projectiles have been designed for shotguns where targets are too large to be affected by scattered shot. Such projectiles are typically larger than rifle slugs but have much less range or accuracy.

Conventional handguns or pistols are typically very limited in their accuracy and range. Gun recoil, projectile mass, and muzzle velocity trade-offs are involved in ammunition designed for handguns. For example, the standard 0.45 caliber pistol fires a conventional ballistic projectile weighing 234 grains at a muzzle velocity of 825 ft/sec. The recoil characteristics of this weapon are notoriously well-known, and it is fired with accuracy only by highly skilled and trained shooters. Personal defense weapons such as pistols and other small arms weapons involve a compromise between bullet size and weight, launch velocity, and projectile velocity decay rate. These small arms are naturally less cumbersome than either a rifle or a shotgun, but accuracy and range are sacrificed and they lack the hit capabilities of both. Handguns are accurate weapons in the hands of trained personnel, however, it has been shown that the average trained user is not accurate, particularly under stress. Moreover, in the case of police or military use, if a high mass, low velocity handgun projectile impacts the target, insufficient shock-power may result so that even though wounded, a human target can return the "fire" and continue to constitute a combat threat. Where low mass projectiles are used because of the recoil problem, such as shot, pellets or bee-bees, the pistol lacks shock-power.

Modern small caliber firearms, as discussed above, have many shortcomings. The rifle is accurate but cumbersome and unwieldy. The shotgun has minimal range but is dangerous if fired with broadly scattering shot, has poor shock-power, and is heavy to carry. The pistol or hand weapon has poor accuracy and poor range, and generally inferior shock-power when compared with the rifle or shotgun slug, but are much more convenient for wearing on the person when not in use.

The invention in this case overcomes some of the above shortcomings. It is a complete departure from my earlier filed cases dealing with ring airfoil munitions; i.e., Ser. No. 105,751 filed 6 Jan. 1971 and now abandoned, and Ser. No. 272,252, a continuation-in-part filed 11 July 1972, and to issue as U.S. Pat. No. 3,877,383 on 15 Apr. 1975.

SUMMARY

The invention is a composite cartridge having a sabot 21 shown for example in FIG. 7 within which a plurality of ring-shaped projectiles 20 are axially aligned. When fired from a gun, sabot 21 moves rapidly through the rifled barrel and exits the muzzle at a high spinning rate. The sabot separates from the ring projectiles which proceed toward the target in a closely grouped pattern which does not enlarge during the entire trajectory of the projectiles.

DESCRIPTION OF THE INVENTION

Figure 1:
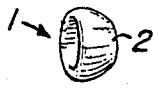
FIG. 1 is an isometric view of my ring airfoil projectile.

Referring to FIG. 1, ring airfoil 1 has a solid body 2 which may be of brass, copper, nickel, aluminum, steel, alloys thereof or any other suitable metals including plastic.

Figure 2:
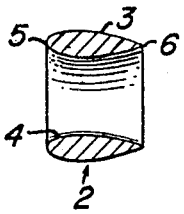
FIG. 2 is a sectional view of my ring airfoil projectile showing the aerodynamic shaping.

FIG. 2 is a sectional view of ring airfoil 1, from which it may be seen that body 2 is defined by outer aerodynamic curvilinear surface 3 and inner aerodynamic surface 4 which together define a ring airfoil shape. Leading edge 5 and trailing edge 6 define the longitudinal extremes of projectile 1. Trailing edge 6 has a very small radius, however, it should be understood that it could be large, blunt or even be a cut off. Leading edge 5 has a larger radius than trailing edge 6 which is consistent with airfoil design parameters for subsonic velocities. A combination of metals and alloys thereof can be used as the core of projectile 1 with a coating of outer layer of either another metal or alloy or of plastic. The outer layer could function as an impact medium to cushion the projectile or absorb energy at impact, be a corrosive preventative on the projectile, or serve to engage the rifling in a gun barrel. Also, the outer layer could serve as a ballast for giving the projectile proper aerodynamic balance. The core could be substantially solid and/or non-metal and the shell or outer layer could be of metal. In each example above, projectile body 2 is intended to be integral and substantially solid, although it could be frangible also.

Figure 3:
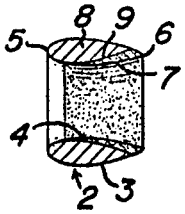
FIG. 3 is my ring airfoil much like that of FIG. 2 with two diverse materials, with the trailing material acting either as a ballast, tracers, or incendiary.

An example of plural materials for projectile body 2 is shown in FIG. 3 wherein body 2 is comprised of portion 7 and portion 8. Portion 7 is tracer material of well-known composition, while portion 8 may be metallic as depicted or of plastic, a combination of metals, or alloys thereof. Outer curvilinear surface 3 is preferably smooth and unbroken at the material interface 9, so that a ring airfoil shape remains after tracer 7 burns off.

Figure 4:
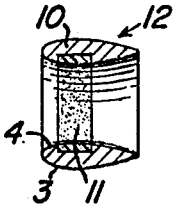
FIG. 4 shows a second material like that of FIG. 3 occupying an internal portion of the ring airfoil projectile.

Referring to FIG. 4, projectile 1 has body 12 of two distinct materials such as metal portion 10 and tracer or incendiary material 11 of conventional composition. Material 11 could be of plastic or other material which would function as ballast material, or weight material for dynamic stability and aerodynamic lift purposes. For these last mentioned purposes, metals or alloys thereof could be used as element 11. Alternatively, element 11 could be an annular slot in portion 10 and located on the outer surface 3.

Figure 5:
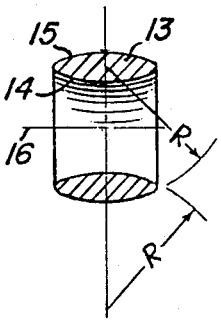
FIG. 5 shows my ring airfoil of a supersonic or lenticular profile.

In the embodiment shown by FIG. 5, projectile 13 is of slightly different aerodynamic shape for use at supersonic velocities. The radius of curvature, R, both for inner surface 14 and outer surface 15 of the projectile are equal. The familiar airfoil shape seen in cross section in FIGS. 2–4 has too much air resistance for supersonic speeds. Balance on its spin axis is important to this design, since rotational spin imparted to projectile 1 and 13 on their axis is from 2000 to over 100,000 rpm to insure gyroscopic stability. The center rotational axis of symmetry 16 is that about which projectile 13 rotates. For other aspects of using a ring airfoil projectile and some of its features primarily in the military area, reference may be made to issued U.S. Pat. No. 3,877,383.

Figure 6:
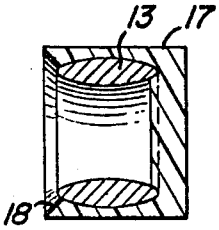
FIG. 6 shows a projectile like that of FIG. 5 disposed within a sabot.

Referring to FIG. 6, projectile 13 is shown nested or enveloped by cylindrical sabot 17. Sabot 17 is adapted to engage the bore of a conventional gun barrel to impart spinning motion to the sabot and the projectile engaged therewithin.

In the case of ring airfoil projectiles, spin provides a larger stability effect than that associated with conventional projectiles. In operation, sabot 17 is forced by propellant to engage rifling along the barrel until it leaves the muzzle of the firearm. Thereafter, aerodynamic and centrifugal forces combined with the relative resiliency or conical flexibility of the sabot results in separation of the sabot from the projectile 13. The conical shape of the forward position 18 of sabot 17 aids in causing air pressure to deform or spread sabot 17 radially outwardly and release projectile 13. Sabot 17 can be of metal, alloys thereof, or plastic, and in the preferred embodiment is light weight plastic sufficiently rigid to transfer propellant force to projectile 13.

Figure 7:
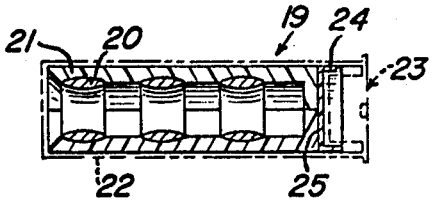
FIG. 7 shows my multi-ring cartridge adapted to be fired from a conventional firearm.
Figure 8:
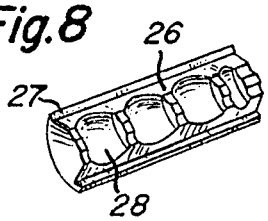
FIG. 8 is a sabot portion for housing my ring airfoils.
Figure 9:
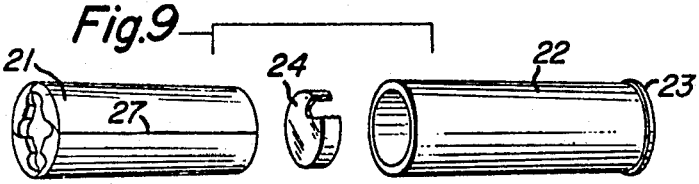
FIG. 9 is an expanded section depicting the sabot assembly, the obturator disc, and the cartridge casing.

Hit power and shock-power are enhanced by the use of cartridge 19 seen in FIGS. 7, 8 and 9. Cartridge 19 has the external shape of a conventional cartridge, but comprises three in-line ring airfoils 20 held in axially aligned and spaced-apart relationship by sabot 21 which is preferably of plural longitudinal segments 26 (see FIG. 8) frictionally held within casing 22 shown dotted in FIG. 7. Segments 8 may optionally be releasably held by light adhesive or interlocking means. Primer and propellant means 23 and appropriate propellant are also shown in dotted fashion. Any conventional and known assemblage that will provide launching force and power will suffice. The external configuration of the cartridge 19 would depend upon the specific caliber gun in which it will be used. Between sabot 21 and propelling means 23 is an obturator disc 24 which acts as a seal to insure that maximum force from detonation of propellant means 23 is applied to the rear-most surface 25 of sabot 21. Illustratively, three segments 26 shown in FIG. 8 firmly enclose the three airfoil rings 20. Due to rotational and other forces after leaving a gun muzzle, segments 26 separate at interfacing joints 27. The external surface of the elongate cylindrical sabot 21 engage the rifling of the gun barrel whereby rotation is provided to the sabot and the projectiles it contains. Cavities 28 shown in FIG. 8 are configured to engage the external surface of the individual airfoil rings 20. However, only a portion of surface engagement thereof may be adequate to impart forward motion and rotation to rings 20. It is also within the scope of this invention to make cavities 28 in the form of "through apertures" such as by casting a web of plastic or metal matrix material therebetween so that sabot 21 functions as a spacer. In such case, each of the airfoil projectile rings 20 would engage the rifle bore about their outer circumferential surface. Such a modified structure could be had by molding or casting metal or nonmetal of lower melting point than the projectiles 20 in a suitable casting and molding apparatus, not shown. Sabot 21, whether it be a mere temporary separator or spacer of plural airfoil rings 20, or segments 26 with or without access to the gun bore, or casing 22, must be discardable during the trajectory of the items fired from the gun barrel. Joints 27 could be weakened such as by inscribing or creasing lines in sabot 21. Alternatively, the entire sabot could be disintegratable at launch or fractionable by centrifugal or rotational forces. In operation, after sabot 21 is shed from the airfoil rings 20, the rings continue along their common trajectory while rotating from 2000 to 100,000 rpm as they proceed toward the target.

Minor dispersion of the 3 in-line projectiles 20 will naturally occur due to variables such as air pressures, winds, and slight variation in forces associated with release of the rings by sabot 21 at the muzzle. Based on considerable testing, it has been found that the 3 projectiles stay in close proximity with each other and remain in a tight cluster throughout their trajectory. Actual test results using a 20 gauge cartridge of an assemblage such as that in FIG. 7 indicated that at fifty feet the cluster covered a pattern diameter of 10 to 18 inches. Generally with three rings, a triangular hit pattern results covering an area not larger than a human silhouette. It will be understood that, while 3 ring projectiles have been shown in FIG. 7, any number of such projectiles could be used in sabot 21 depending upon the size of the rings, the caliber of the gun used with the sabot, and other such considerations.

Figure 10:
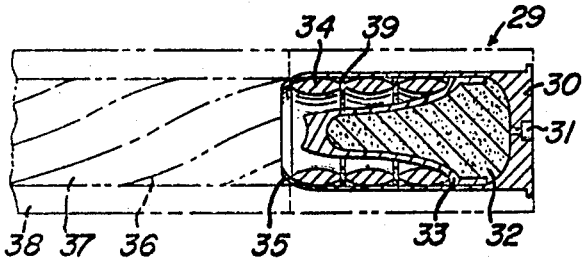
FIG. 10 depicts the conventional gun barrel with rifling to engage the rings without a sabot and with the obturator including the propellant.

FIG. 10 depicts a further modification exemplified by cartridge 29 which has casing 30 of inexpensive metal housing the primer means 31, powder 32, powder holder or sleeve 33, and three coaxially aligned airfoil rings 34. Casing 30 is preferably brass, whereby the projectile or launch end is closed with a turned edge 35 in a rounded manner to hold projectiles 34 therein. Cartridge 29 uses no sabot, but relies upon obturator or holder element 33 to push the in-line airfoils 34 one against the other to expand the overturned edge 35 and allow the projectiles 34 successively to engage rifling 36 of bore 37 in barrel 38 of any conventional gun. As discussed above, projectiles 34 leave the muzzle in a cluster. Here as they leave the muzzle of barrel 38, they each are rotating from 2,000 to over 100,000 rpm, thereby having considerable gyroscopic stability. Each projectile develops its own lift as it heads toward the target. Ring airfoils 34 in FIG. 10 as in FIGS. 5–7 with projectiles 13 and 20, respectively, are illustratively depicted as supersonic airfoil configurations. However, subsonic teardrop configurations and other conventional airfoil shapes will work as well depending upon muzzle velocities, to achieve closely controlled dispersion patterns. Casing 30 can be of metal such as cooper, brass, aluminum, or steel or alloys thereof preferably for safety reasons, although it is foreseeable that certain plastics might be substituted therefor. Primer means 31 and powder 32 can be of conventional type and element 33 should be of metal such as brass, steel, or copper with enough strength to allow it to push rings 34 forward through barrel 38. Ring airfoils 34, as aforementioned, can be of plastic, metals such as copper, lead, brass, bronze, steel, iron, aluminum, and alloys thereof, without departing from my invention concept. Additionally, if required, spacers 39 between projectiles may assist in separation in flight. In operation, some limited dispersion is desirable so as to increase hit probability. In comparison with the projectiles of FIG. 7 at fifty feet, the hit area for the structure of FIG. 10 is less than that of projectiles 20. Nonetheless, this combination also is controlled and fulfills the long felt need of providing greater range, and greater hit power by way of dispersion than do conventional projectiles. As before, the number of ring airfoil projectiles 34 in a cartridge will depend upon the desires of use.

Figure 11:
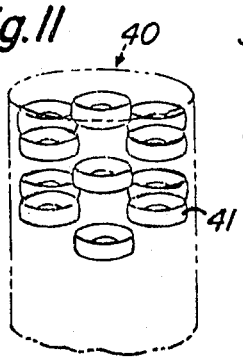
FIG. 11 is another arrangement of ring airfoil projectiles.
Figure 12:
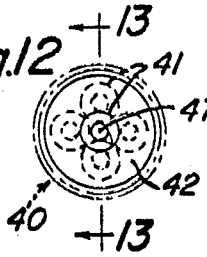
FIG. 12 is an end view of FIG. 13.
Figure 13:
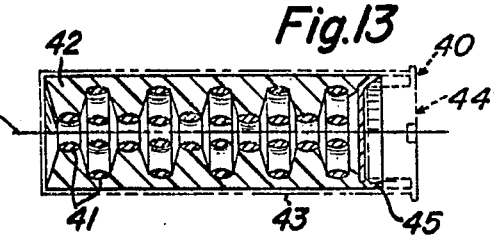
FIG. 13 is a section of FIG. 12 depicting the ring locations, obturator, etc.

FIGS. 11, 12, and 13 depict another modification of the inventive concept. Referring to FIG. 13, cartridge 40 has five groupings or gangs of projectiles 41 disposed therein. Each grouping (see FIG. 12) comprises five ring airfoil projectiles 41. Projectiles 41 are temporarily contained in cartridge 40 by way of sabot 42 which can have a segment configuration similar to that of FIG. 8. In FIG. 13, cartridge 40 comprises casing 43 to which is coupled primer and powder containing end 44. Also contained in casing 43 is obturator disc 45 which seals and is intermediate the powder and sabot 42. To the left of disc 45 lies sabot 42 which envelopes 25 ring airfoil projectiles. From FIGS. 11 and 12 may be seen the displaced arrangement of projectile 41 of multi-ring airfoil projectile cartridges 40. As seen from FIG. 12, they are disposed into five gangs or tiers offset longitudinally in this assemblage for conservation of diametrical dimensions and to minimize aerodynamic interference in flight. The number of projectiles in each gang or tier is not critical and can be varied. Sabot 42 is preferably made of plural longitudinal segments to properly hold rings 41 until sabot 42 has cleared the muzzle. Then it is separated and all the rings progress in the direction of the target in a rotating cluster of respectively rotating ring airfoil projectiles 41. That is, each rotates upon its own centroidal axis while flying in a direction parallel to the common trajectory. Each ring airfoil projectile has the same rotational velocity as that of the sabot rotational velocity upon muzzle exit. This assemblage by far exceeds the hit power (which is also controlled) anticipated with a conventional projectile. Using cartridge 40 with controlled dispersion, it is readily seen that the hit area is greatly enlarged. In this embodiment, minor cantoring or angling off the common axis of launch enlarges the dispersion cone, hence, the hit area. The common axis of launch is the centroidal axis 47 of the cartridge as seen from FIGS. 12 and 13. Cartridge 40 can be made of diverse materials mentioned above without departing from my invention. That is, casing 43 can be of plastic or paper with the powdered primer end 44 being composed of metal such as steel, aluminum, copper, or alloys thereof without departing from the invention. These components can be jointed in a conventional way as by crimping 43 to 44, glue, adhesive, etc. Obturator disc 45 can be metal or plastic sufficiently rigid to function as a seal. Sabot 42 can be made like that of FIGS. 7, 8, and 9 above described. Sabot 42 can be frictionally or adhesively held in casing 43, for example, so long as the propellant force is great enough as to break the sabot-casing interface to enable launch. Numerous other designs and configurations are condeivable without departing from my invention.

OPERATION

In operation projectile body 2 of FIGS. 1–4 and of FIG. 5, can be launched from a sabot 17 as depicted in FIG. 6, a cartridge like that of FIG. 7, FIG. 10 or that of FIG. 13 or by any other launching means that will spin the projectiles over 2,000–100,000 rpm and give it muzzle velocity of conventional firearms or higher. The projectile will have extended range, larger shock power, hit power and better performance than conventional projectiles with equal or greater means.

The subsonic type of ring airfoil of FIGS. 1–4 has a chord length, i.e., the distance from the cross-section leading edge to trailing edge, that is less than the projectile diameter. In the case of a 0.50 caliber diameter, the chord or longitudinal length, or dimension in the flight direction, is approximately 0.25 inches. When fabricated from mild steel the projectile weighs approximately 32 grains and in a polyethylene material sabot such as in FIG. 8, would allow three subsonic ring airfoils of 0.50 caliber diameter to be launched from a 20 gauge size casing, FIG. 9, at a velocity of 1,100 ft/sec. Although this velocity is beyond the most aerodynamically efficient for this thick cross-section, it enables the range to be extended while the projectiles' velocity decays to the more efficient subsonic range. Further, the higher launch velocity does not impose a high recoil load on the gunner, due to the low projectile mass.

Where the projectile is specifically intended as a tracer (FIGS. 3, 4) standard military tracer composition is used, including any variations in magnesium and phosphorous compounds.

The supersonic type of ring airfoil cross-section of FIG. 5 generally has a diameter to chord ratio of 2 to 1. When fabricated of mild steel, these shapes weigh approximately 22 grains in a 0.45 caliber size. In the multi-ring cartridge arrangement of FIG. 10, the three rings may be launched at velocities of 1,600 ft/sec. The initial total kinetic energy is the same as the conventional 0.45 caliber cartridge, but the impulse felt by the shooter is lower and hence accuracy is increased.

FIG. 13 is an arrangement for a shot gun shell in a 12 or 10 gauge size. Each ring would thus be approximately 0.25 to 0.30 inches in diameter. This would result in very low projectile weight and high muzzle velocity. However, it is understood that mere design changes could render either of the above examples usable in either a rifle, shotgun, or hand gun (pistol).

This invention provides more hit power, shock power, and range than small arms conventional projectiles without increasing the recoil force. Also, by using small ammunition multi-rings, a broad hit area is provided while contemporaneously increasing the shock power, hit ability, and range of hand gun or pistol. This is done by providing aerodynamically shaped annular ring airfoils to achieve dramatic reduction of resistance in conjunction with a lift force developed in flight to extend their range and accuracy, and also to provide a narrow dispersion and small hit area.

An important feature of this invention is the use of a low drag, nonconventional ballistic projectile, or ring airfoil configuration having extremely high gyroscopic stability when spun and capable of generating lift forces as it flies downrange. Because of its lift force, the projectile offsets gravity and has a substantially flat trajectory in comparison to conventional projectiles. The lethality of the projectile exceeds that of conventional hand gun projectiles having more mass. The multi-hit probability of this projectile increases the chances of hitting a target with a hand gun even where shooters are not highly trained. This is so, because most pistol and rifle bullets and shot gun slugs are bulbous and contoured to reduce air friction. My projectile, when compared with conventional projectiles, not only reduces air friction per unit mass, but has a higher hitting power at target impact and further has aerodynamic shaping for lift purposes. Because of my unique aerodynamic shapes, my projectiles can be launched at higher muzzle velocities than conventional projectiles of like mass while contemporaneously lowering recoil force. The dispersion of the projectiles increases the effectiveness of the system in that a larger downrange impact area is covered. This produces a much higher first round hit probability than single projectiles of conventional rifle and pistol systems which are more prone to error due to muzzle disturbances and aim.

Advantages of the multi-ring or projectile cartridge are readily seen. Greater hit probability at close quarters with an attendant and significant increase in effective shocking-power to the target. The hitting ability combined with the increased shock-power will reduce the need for additional firings to produce a "knock-down". Thus, the use of my multi-ring or multi-projectile cartridge will maximize the first round hit probability, with a maximizing of stopping-power to the target.

Although I have herein set forth my invention with respect to certain specific principles and details thereof, it will be understood that these may be varied without departing from the spirit and scope of the invention as set forth in the hereinunder appended claims.

I claim:

1. A composite small caliber cartridge including:

a cartridge case for containing a propellant gas source, force transmitting means frictionally held within said cartridge case, and a plurality of projectiles firmly engaged within said force transmitting means, each of said projectiles consisting of an annular shaped hollow ring symmetrical about a center rotation axis and having a circular leading edge and a circular trailing edge, said leading and trailing edges being spaced apart a distance less than the diameter of said ring, said plurality of projectiles in said force transmitting means having said center rotation axes in coincidence whereby rotation of said force transmitting means causes rotation of said projectiles about said coinciding axes.

2. The structure set forth in claim 1 above, wherein:

said force-transmitting means comprises a sabot adapted to separate from said projectiles after leaving a gun muzzle from which said cartridge is fired.

3. The structure set forth in claim 2 above, wherein:

each of said ring projectiles has a center longitudinal axis therethrough and said projectiles are aligned within said sabot in spaced-apart relationship with said center axes coinciding.

4. The structure set forth in claim 3 above, wherein:

said sabot is of elongate cylindrical shape having a center longitudinal axis about which the sabot rotates as it leaves the muzzle of a gun, and said projectile axes coincide with said center axis of said sabot.

* * * * *